US009347669B2

(12) United States Patent
Stuttaford et al.

(10) Patent No.: US 9,347,669 B2
(45) Date of Patent: May 24, 2016

(54) VARIABLE LENGTH COMBUSTOR DOME EXTENSION FOR IMPROVED OPERABILITY

(71) Applicants: Peter John Stuttaford, Jupiter, FL (US); Stephen Jorgensen, Palm City, FL (US); Yan Chen, Woodinville, WA (US); Hany Rizkalla, Stuart, FL (US); Khalid Oumejjoud, Palm Beach Gardens, FL (US); Mirko R. Bothien, Zurich (CH)

(72) Inventors: Peter John Stuttaford, Jupiter, FL (US); Stephen Jorgensen, Palm City, FL (US); Yan Chen, Woodinville, WA (US); Hany Rizkalla, Stuart, FL (US); Khalid Oumejjoud, Palm Beach Gardens, FL (US); Mirko R. Bothien, Zurich (CH)

(73) Assignee: ALSTOM TECHNOLOGY LTD., Baden (CH)

( * ) Notice: Subject to any disclaimer, the term of this patent is extended or adjusted under 35 U.S.C. 154(b) by 301 days.

(21) Appl. No.: 14/038,016

(22) Filed: Sep. 26, 2013

(65) Prior Publication Data

US 2014/0090389 A1 Apr. 3, 2014

Related U.S. Application Data

(60) Provisional application No. 61/708,323, filed on Oct. 1, 2012.

(51) Int. Cl.

| | |
|---|---|
| ***F23R 3/16*** | (2006.01) |
| ***F23R 3/54*** | (2006.01) |
| ***F23R 3/28*** | (2006.01) |

(Continued)

(52) U.S. Cl.

CPC ... *F23R 3/54* (2013.01); *F23R 3/14* (2013.01); *F23R 3/16* (2013.01); *F23R 3/26* (2013.01); *F23R 3/286* (2013.01); *F23R 3/34* (2013.01); *F23R 3/343* (2013.01); *F23R 3/60* (2013.01); *F23C 2201/20* (2013.01); *F23C 2900/06043* (2013.01); *F23C 2900/07001* (2013.01);

(Continued)

(58) Field of Classification Search

CPC ..... F23R 3/54; F23R 3/14; F23R 3/16; F23R 3/26; F23R 3/286; F23R 3/34; F23R 3/343; F23R 3/60; F23C 2201/20; F23C 2900/06043; F23C 2900/07001; F23C 2900/00014; F23C 2900/03343

USPC ..... 60/39.11, 749, 733, 737, 738, 746, 748, 60/752, 770

See application file for complete search history.

(56) References Cited

U.S. PATENT DOCUMENTS

| | | | |
|---|---|---|---|
| 2,457,157 | A | 12/1948 | King, Jr. |
| 5,121,597 | A | 6/1992 | Urushidani et al. |

(Continued)

FOREIGN PATENT DOCUMENTS

| | | |
|---|---|---|
| EP | 0747635 | 12/1996 |
| WO | 9906767 A1 | 2/1999 |

OTHER PUBLICATIONS

U.S. Appl. No. 14/038,029, filed Sep. 26, 2013, 64 pages.

(Continued)

*Primary Examiner* — Steven Sutherland

(74) *Attorney, Agent, or Firm* — Shook, Hardy & Bacon L.L.P.

(57) ABSTRACT

The present invention discloses a novel apparatus and method for operating a gas turbine combustor having a structural configuration proximate a pilot region of the combustor which seeks to minimize the onset of thermo acoustic dynamics. The pilot region of the combustor includes a generally cylindrical extension having an outlet end with an irregular profile which incorporates asymmetries into the system so as to destroy any coherent structures.

20 Claims, 12 Drawing Sheets

(51) Int. Cl.

| | |
|---|---|
| ***F23R 3/26*** | (2006.01) |
| ***F23R 3/60*** | (2006.01) |
| ***F23R 3/34*** | (2006.01) |
| ***F23R 3/14*** | (2006.01) |

(52) U.S. Cl.
CPC ..... *F23R2900/00014* (2013.01); *F23R 2900/03343* (2013.01)

(56) References Cited

U.S. PATENT DOCUMENTS

| | | | | |
|---|---|---|---|---|
| 5,129,226 | A * | 7/1992 | Bigelow | F23R 3/18 60/749 |
| 5,676,538 | A * | 10/1997 | Lovett | F23D 23/00 431/182 |
| 5,802,854 | A | 9/1998 | Maeda et al. | |
| 5,983,642 | A | 11/1999 | Parker | |
| 6,056,538 | A * | 5/2000 | Buchner | F23C 7/02 431/115 |
| 6,558,154 | B2 | 5/2003 | Eroglu et al. | |
| 6,935,116 | B2 | 8/2005 | Stuttaford et al. | |
| 6,986,254 | B2 | 1/2006 | Stuttaford et al. | |
| 7,137,256 | B1 | 11/2006 | Stuttaford et al. | |
| 7,237,384 | B2 | 7/2007 | Stuttaford et al. | |
| 7,308,793 | B2 | 12/2007 | Oumejjoud et al. | |
| 7,513,115 | B2 | 4/2009 | Stuttaford | |
| 7,677,025 | B2 | 3/2010 | Stuttaford et al. | |
| 2006/0168966 | A1 | 8/2006 | Stuttaford | |
| 2009/0111063 | A1 | 4/2009 | Boardman | |
| 2011/0094233 | A1 * | 4/2011 | Kashihara | F23R 3/34 60/737 |

OTHER PUBLICATIONS

U.S. Appl. No. 14/038,064, filed Sep. 26, 2013, 56 pages.
U.S. Appl. No. 14/038,038, filed Sep. 26, 2013, 50 pages.
U.S. Appl. No. 14/038,056, filed Sep. 26, 2013, 51 pages.
U.S. Appl. No. 14/038,070, filed Sep. 26, 2013, 74 pages.
PCT Application No. US2013/062693, Search Report dated Mar. 14, 2014, 11 pages.
PCT Application No. US2013/062668, Search Report dated Mar. 24, 2014, 60 pages.
PCT Application No. US2013/062688, Search Report dated Mar. 24, 2014, 17 pages.
PCT Application No. US2013/062673 Search Report and Written Opinion dated Apr. 11, 2014; 31 pages.
International Search Report with Written Opinion mailed Jun. 27, 2014 in PCT Application No. PCT/US2013/062678, 11 pages.

* cited by examiner

VARIABLE LENGTH COMBUSTOR DOME EXTENSION FOR IMPROVED OPERABILITY

CROSS-REFERENCE TO RELATED APPLICATIONS

This application claims the benefit of U.S. Provisional Patent Application Ser. No. 61/708,323 filed on Oct. 1, 2012.

TECHNICAL FIELD

The present invention relates generally to a system and method for improving combustion stability and reducing emissions in a gas turbine combustor. More specifically, the improvements in a combustor premixer address acoustic dynamic instabilities and can also reduce thermal stresses, thus improving structural integrity and component life.

BACKGROUND OF THE INVENTION

In an effort to reduce the amount of pollution emissions from gas-powered turbines, governmental agencies have enacted numerous regulations requiring reductions in the amount of oxides of nitrogen (NOx) and carbon monoxide (CO). Lower combustion emissions can often be attributed to a more efficient combustion process, with specific regard to fuel injector location and mixing effectiveness.

Early combustion systems utilized diffusion type nozzles, where fuel is mixed with air external to the fuel nozzle by diffusion, proximate the flame zone. Diffusion type nozzles have been known to produce high emissions due to the fact that the fuel and air burn stoichiometrically at high temperature to maintain adequate combustor stability and low combustion dynamics.

An enhancement in combustion technology is the utilization of premixing, such that the fuel and air mix prior to combustion to form a homogeneous mixture that burns at a lower temperature than a diffusion type flame and produces lower NOx emissions. Premixing fuel and air together before combustion allows for the fuel and air to form a more homogeneous mixture, which will burn more completely, resulting in lower emissions. However, in this configuration the fuel is injected in relatively the same plane of the combustor, and prevents any possibility of improvement through altering the mixing length.

Premixing can occur either internal to the fuel nozzle or external thereto, as long as it is upstream of the combustion zone. An example of a premixing combustor 100 of the prior art is shown in FIG. 1. The combustor 100 is a type of reverse flow premixing combustor utilizing a pilot nozzle 102, a radial inflow mixer 104, and a plurality of main stage mixers 106 and 108. The pilot portion of the combustor 100 is separated from the main stage combustion area by a center divider portion 110. The center divider portion 110 separates the fuel injected by the pilot nozzle 102 from the fuel injected by the main stage mixers 106 and 108. While the combustor 100 of the prior art has improved emissions levels and ability to operate at reduced load settings, analysis and testing has demonstrated the onset of thermo acoustic dynamics due to symmetries generated in the burner as a result of the burner geometry, such as the center divider portion.

As one skilled in the art understands, mechanisms that cause thermo-acoustic instabilities are coherent structures generated by the burner. One type of combustor known to exhibit such instabilities is a combustor having a cylindrical shape. What is needed is a system that can provide flame stability and low emissions benefits at a part load condition while also reducing thermo-acoustic instabilities generated by coherent flame structures.

SUMMARY

The present invention discloses a gas turbine combustor having a structural configuration proximate a pilot region of the combustor which seeks to minimize the onset of thermo acoustic dynamics. The pilot region, or center region of the combustor, is configured to incorporate asymmetries into the system so as to destroy any coherent structures in the resulting flame.

In an embodiment of the present invention, a combustor is disclosed having a combustion liner located within a flow sleeve with a dome located at a forward end of the flow sleeve and encompassing at least a forward portion of the combustion liner. The combustor also comprises a generally cylindrical extension projecting into the combustion liner from the dome, where the outlet end of the extension has an irregular profile.

In an alternate embodiment of the present invention, an extension for a dome of a gas turbine combustor is disclosed. The extension comprises a generally cylindrical member extending along an axis of the combustor where the generally cylindrical member has an outlet end configured to not be located in a single plane perpendicular to the axis of the combustor.

In yet another embodiment of the present invention, a method is provided for isolating a main stage of fuel injectors from a pilot fuel nozzle in order to reduce acoustic dynamics in the combustor. The method comprises providing a combustion liner having a dome and extension component where air is injected into the combustion liner and a first stream of fuel is injected into the extension piece to mix with a portion of the air to form a pilot flame. A second stream of fuel is injected into another portion of the air located outside of the combustion liner. This mixture is then directed into the combustion liner in a way such that the second stream of fuel is separated from the first stream of fuel by the extension piece.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

By way of reference, this application incorporates the subject matter of U.S. Pat. Nos. 6,935,116, 6,986,254, 7,137,256, 7,237,384, 7,513,115, 7,677,025, and 7,308,793.

The preferred embodiment of the present invention will now be described in detail with specific reference to FIGS. 2-12. The combustion system of the present invention utilizes premixing fuel and air prior to combustion in combination with precise staging of fuel flow to the combustor to achieve reduced emissions at multiple operating load conditions. Reconfigured combustor geometry is provided to target a reduction of combustion acoustic pressure fluctuations, to reduce thermal stresses, cracking and detrimental thermo-acoustic coherent structures.

Figure 2:
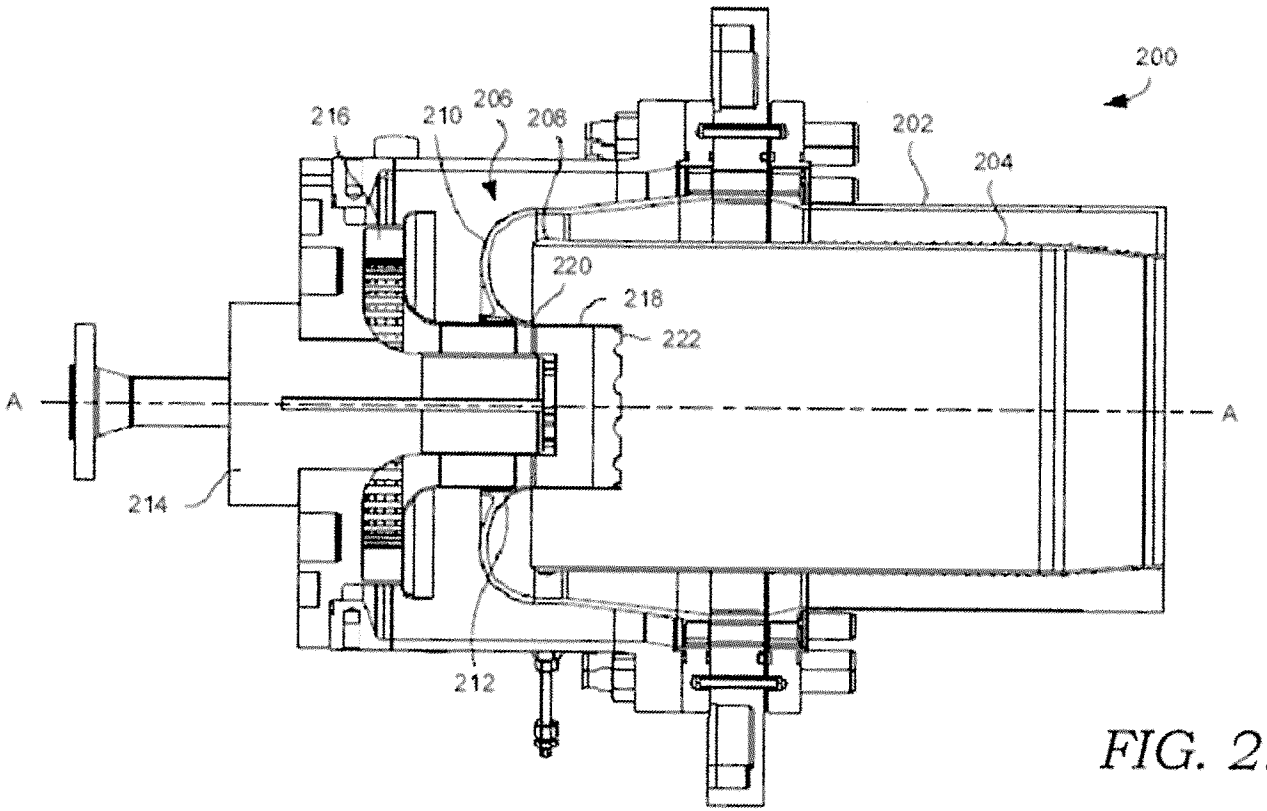
FIG. 2 is a cross section view of a gas turbine combustion system in accordance with an embodiment of the present invention.

Referring now to FIG. 2, a gas turbine combustion system 200 is provided comprising a generally cylindrical flow sleeve 202 and a generally cylindrical combustion liner 204 located at least partially within the flow sleeve 202. The combustion system 200 also comprises a dome 206 located axially forward of the flow sleeve 202. The dome 206 is positioned such that it encompasses at least a forward portion 208 of the combustion liner 204. The dome 206 also has a hemispherical head end 210 and an opening 212 that is coaxial with a center axis A-A of the combustion system 200. The gas turbine combustion system 200 also comprises a pilot nozzle 214 extending generally along the center axis A-A of the combustion system 200 and a radial inflow mixer 216, each for directing a supply of fuel to pass into the combustion liner 204 along or near the center axis A-A.

Figure 1:
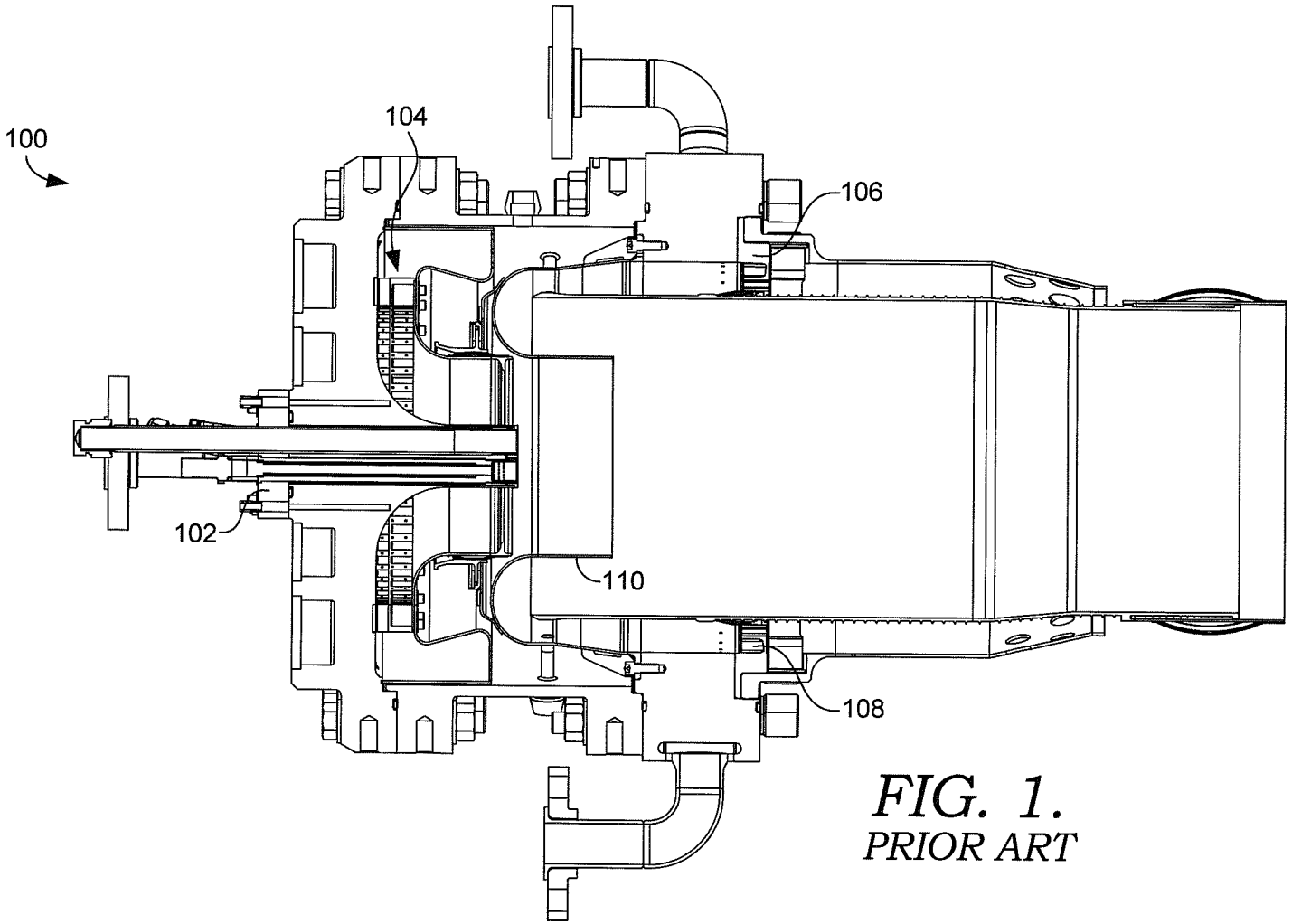
FIG. 1. PRIOR ART
FIG. 1 is a cross section view of a gas turbine combustion system of the prior art.
Figure 3:
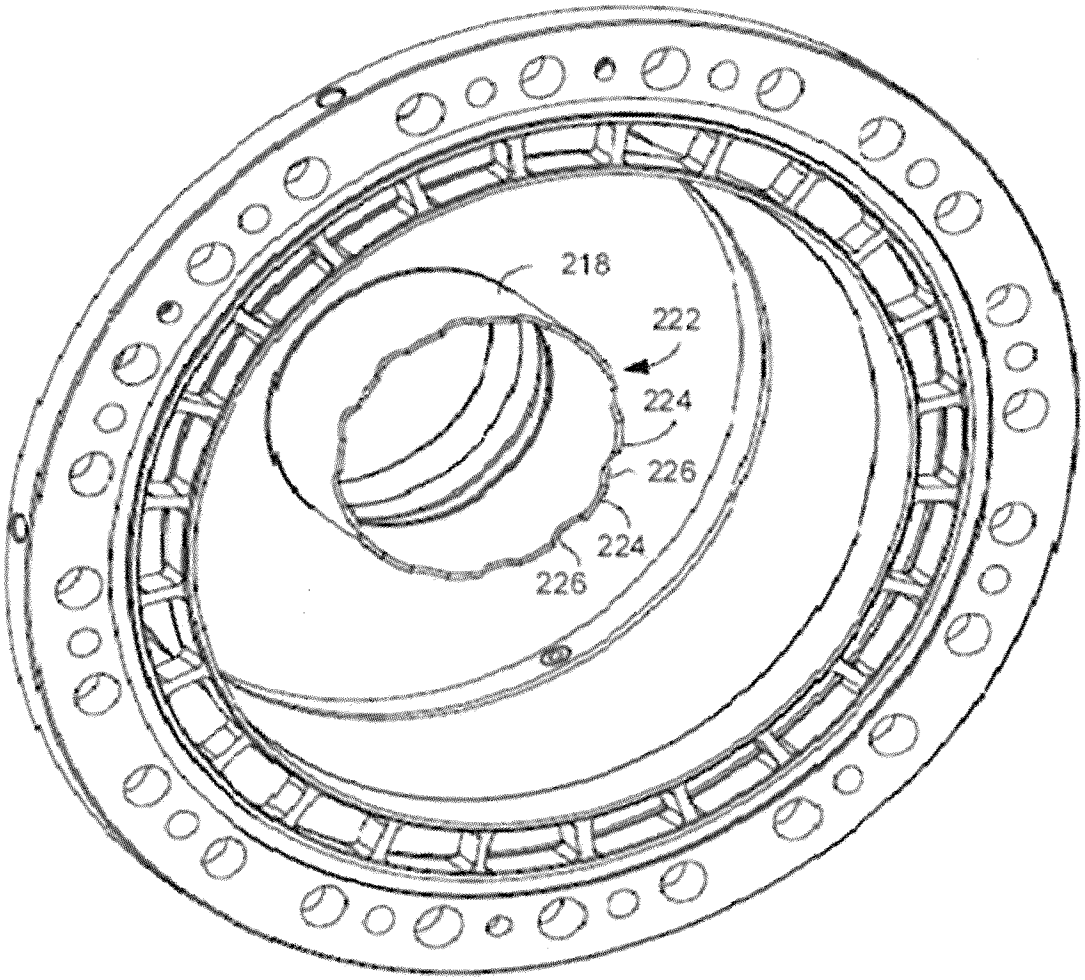
FIG. 3 is a perspective view of a portion of the gas turbine combustion system of FIG. 2 in accordance with an embodiment of the present invention.
Figure 4B:
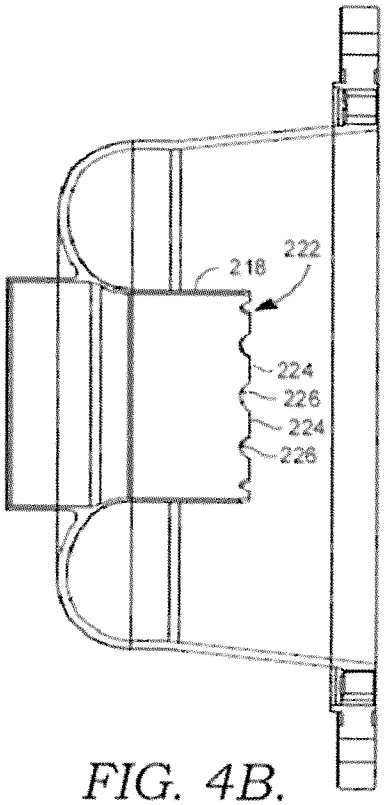
FIG. 4B is an alternate detailed cross section view of a portion of the gas turbine combustion system of FIG. 2 in accordance with an embodiment of the present invention.
Figure 4A:
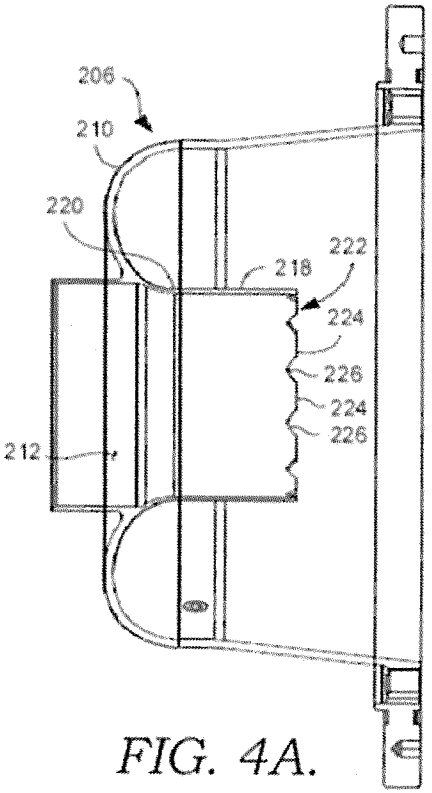
FIG. 4A is a detailed cross section view of a portion of the gas turbine combustion system of FIG. 2 in accordance with an embodiment of the present invention.

Referring also to FIGS. 3, 4A and 4B, the gas turbine combustion system 200 also comprises a generally cylindrical extension 218 projecting into the combustion liner 204 from the dome 206. The precise length of generally cylindrical extension 218 can vary and is chosen based upon the operating parameters defining turndown as the main fuel stage is isolated from the pilot stage by separating the flame regions and avoiding flame quenching at lower operating temperatures. The extension 218 has an inlet end 220 positioned at the opening 212 of the dome 206 and an opposing outlet end 222, which is positioned at a distance within the combustion liner 204. As discussed above, combustors that have a cylindrical structure with uniform exit planes are subject to cracking due to thermal gradients causing circumferential stresses within the cylindrical structure. Furthermore, these combustors also have tendencies to produce thermo-acoustic dynamics having a coherent structure. That is, the acoustic waves formed within the combustor have a uniform structure due to the symmetric structure within the combustor. The combustor of the prior art depicted in FIG. 1 has been known to exhibit circumferential stress-induced cracking and to produce acoustic waves in the center divider portion 110, due to its symmetric structure.

As one skilled in the art will understand, acoustic waves are a by-product of the combustion process due to vortices being shed at a cylindrical burner outlet. When these vortices are convected into the flame, a fluctuation in the heat release occurs. When the acoustic fluctuations amplify the shedding of vortices, a constructive interference with the heat release can occur causing high amplitude dynamics. These high dynamics can cause cracking in the combustor.

The present invention provides reconfigured combustor geometry to help reduce fluctuations in heat release. In the prior art combustor of FIG. 1, the combustor 100 included a center divider portion 110 for separating the flow of fuel in the pilot nozzle 102 from the fuel from main stage injectors 106 and 108. The center divider portion 110 has a cylindrical cross section and a uniform exit plane perpendicular to the flow of fuel and air. As such, vortices shed at the exit plane of the center divider portion 110 are convected into the surrounding main stage flame, which is produced by injection of fuel from injectors 106 and 108. Because of the uniform exit plane of the center divider portion 110, these vortices have been known to cause a fluctuation in heat release and cause high amplitude dynamics. Further, the large temperature gradient experienced by the center divider portion 110 creates circumferential stresses causing cracking of the divider portion.

To improve the prior art combustor design while maintaining the benefit of separate fuel injection circuits required for a combustor having the specified design and staging configuration, the outlet end 222 of the generally cylindrical extension 218 in combustion system 200 is configured to have an irregular profile or shape. An irregular profile or shape has been shown to reduce the temperature gradient and dynamics levels. A variety of irregular shapes can be used for the outlet end 222 of the generally cylindrical extension 218. FIGS. 3-6 depict some of the alternate embodiments of the generally cylindrical extension component having an irregular profile or shape to the outlet end.

Referring to FIGS. 3-4B, the irregular profile or shape of the outlet end 222 comprises a planar edge 224 extending generally perpendicular to the center axis A-A where the planar edge 224 is interrupted by a series of semi-circular cutouts 226. The semi-circular cutouts 226 provide a non-uniform exit plane from the generally cylindrical extension 218. That is, as the flow exits the generally cylindrical extension 218, it will exit into the surrounding flow at slightly different axial locations due to the cutouts 226. As a result, asymmetries are introduced into the exit flow from the generally cylindrical extension 218, which disrupts any coherent structures being formed that could otherwise amplify if injected in a symmetrical pattern. In addition, the semi-circular cutouts 226 tend to reduce the cracking in the generally cylindrical extension 218 by relieving circumferential stresses induced by the thermal gradients in the generally cylindrical extension 218. The exact size, quantity and spacing of the semi-circular cutouts 226 about the outlet end 222 can vary depending on a variety of factors such as frequency of combustion dynamics that should be damped, the flow velocity, flame position, and delay times. For the embodiment of the present invention depicted in FIGS. 3-4B, twelve semi-circular cutouts 226 are equally spaced about the outlet end 222 of the generally cylindrical extension 218. Depending on the combustor design and operating conditions, the cutouts 226 can also be positioned about the outlet end 222 in a non-equal or irregular pattern The irregular profile or shape is not limited to semi-circular cutouts. Alternatively, the irregular profile or shape of the outlet end of the extension 218 can take on other shapes, including but not limited to, a saw tooth pattern, a plurality of rectangular cutouts, and elliptical or sinusoidal cutouts.

Figure 5:
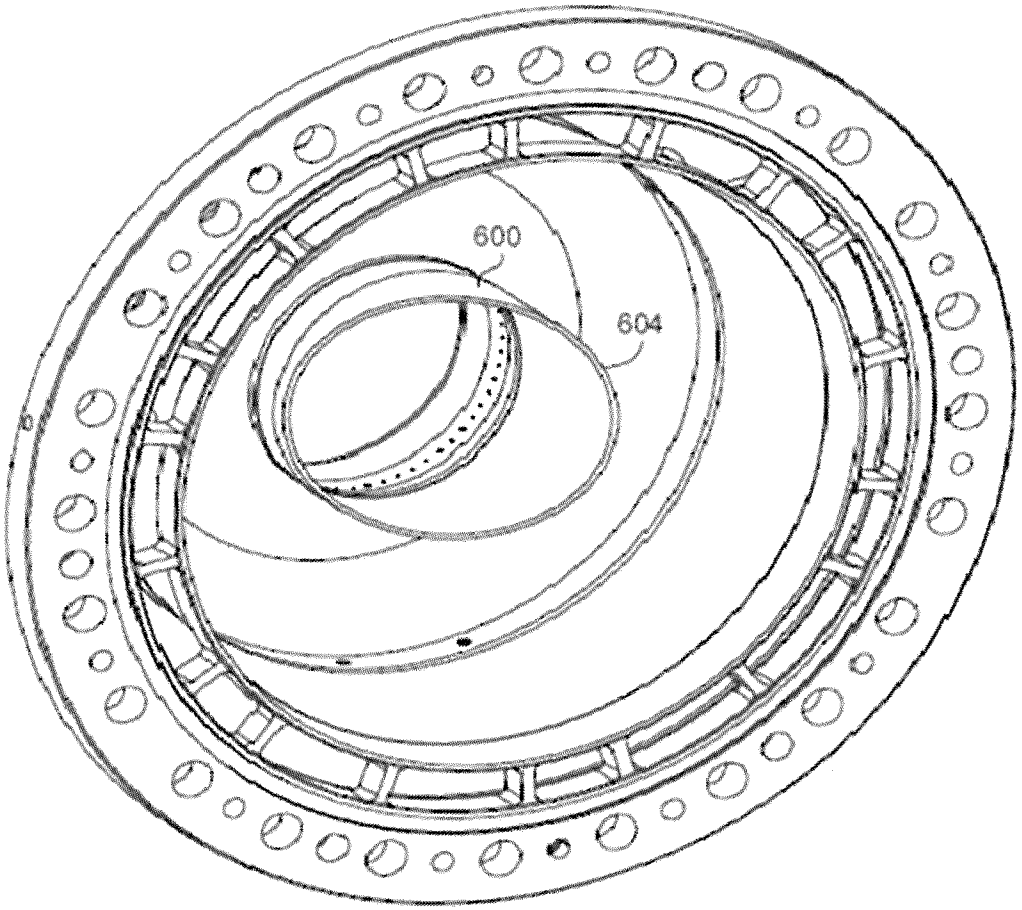
FIG. 5 is an alternate perspective view of a portion of a gas turbine combustion system in accordance with an alternate embodiment of the present invention.
Figure 6:
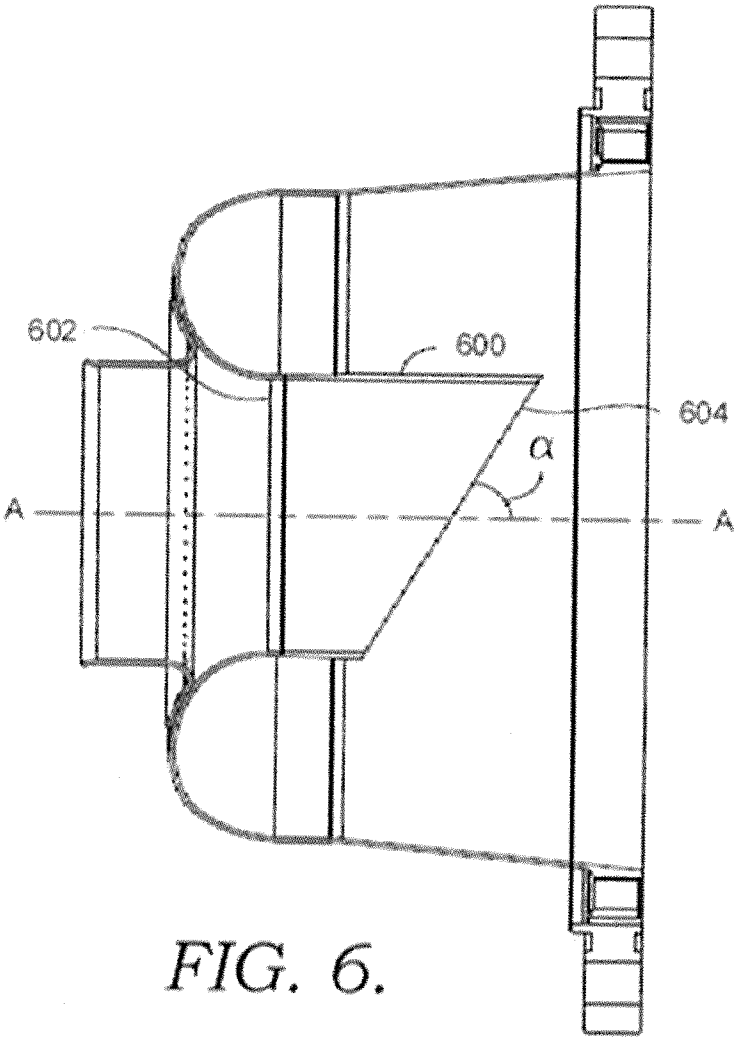
FIG. 6 is a cross section of the portion of a gas turbine combustor of FIG. 5 in accordance with an alternate embodiment of the present invention.

An alternate embodiment of the present invention is depicted in FIGS. 5 and 6. The alternate embodiment discloses a generally cylindrical extension 600 having a different geometry than that of the cylindrical extension 218 discussed above. The generally cylindrical extension 600 has an inlet end 602 and an opposing outlet end 604. The cylindrical extension 600 is coupled to the dome and functions similar to the prior configuration discussed above and pictured in FIGS. 2-4B. The main difference with the alternate generally cylindrical extension 600 is with respect to the irregular shape of the outlet end 604. For the embodiment depicted in FIGS. 5-6, the outlet end 604 forms a plane taken at an angle $\alpha$ relative to the center axis A-A, such that the outlet end 604 is not in a single plane perpendicular to the center axis A-A of the combustion system. As with the semi-circular cutouts in the outlet end of the cylindrical extension 218, the angular planar cut at outlet end 604 of cylindrical extension 600 provides an alternate way of introducing asymmetries into the flow of the combustion liner.

Figure 7:
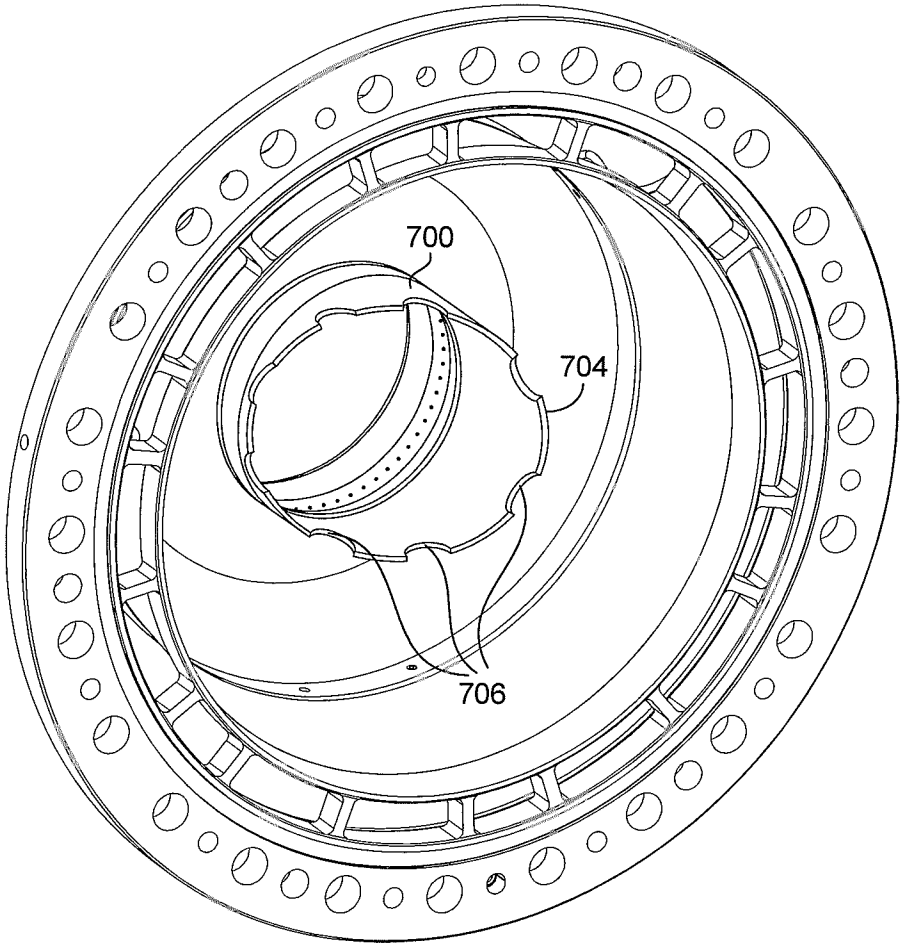
FIG. 7 is a perspective view of a portion of a gas turbine combustion system in accordance with yet another alternate embodiment of the present invention.
Figure 8:
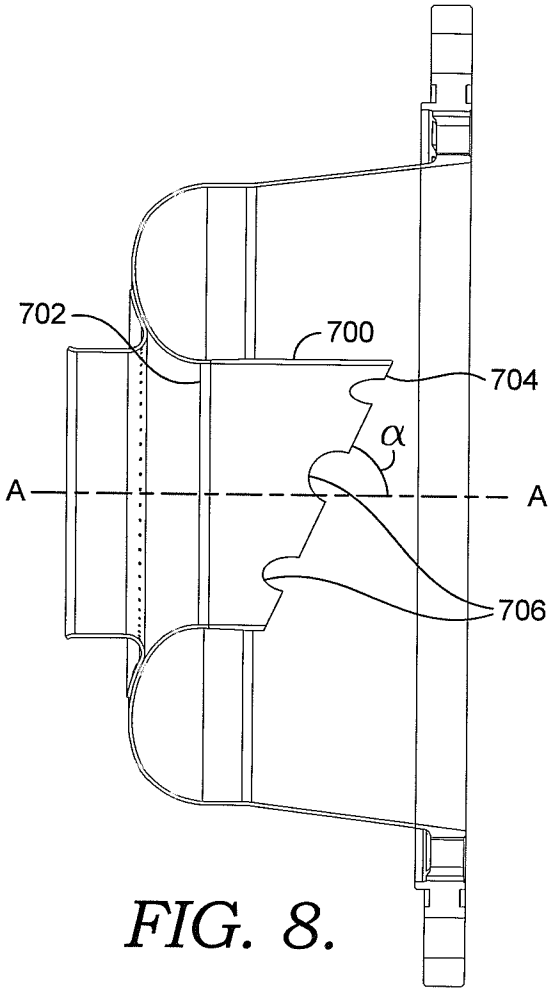
FIG. 8 is a cross section of the portion of a gas turbine combustor of FIG. 7 in accordance with an alternate embodiment of the present invention.

Yet another embodiment of the present invention is depicted with respect to FIGS. 7 and 8. This alternate embodiment discloses a generally cylindrical extension 700 having a different geometry than the embodiments discussed above. The generally cylindrical extension 700 has an inlet end 702 and an opposing outlet end 704. The cylindrical extension 700 is coupled to the dome and functions similar to the prior configuration discussed above and pictured in FIGS. 2-6. In the configuration depicted in FIGS. 7 and 8, it is possible to obtain the acoustic benefits driven primarily by the configuration of FIGS. 5 and 6, with the thermal stress reductions that can be obtained through the cutouts in the outlet end of the extension, as depicted in FIGS. 3-4B. That is, the main difference with this alternate generally cylindrical extension 700 is with respect to the irregular shape of the outlet end 704. For the embodiment depicted in FIGS. 7 and 8, the outlet end 704 forms a plane taken at an angle $\alpha$ relative to the center axis A-A, such that the outlet end 704 is not in a single plane perpendicular to the center axis A-A of the combustion system. As discussed above, the angular planar cut at outlet end 704 of cylindrical extension 700 provides a way of introducing asymmetries into the flow of the combustion liner Furthermore, and as discussed above, including a plurality of cutouts 706 in the outlet end 704 helps reduce the thermal stresses within the generally cylindrical extension 700. Although generally semi-circular cutouts 706 are shown in FIGS. 7 and 8, the size and shape of these cutouts can vary to include other shapes, such as, but not limited to rectangular, elliptical, sinusoidal or saw-tooth shape.

Figure 9:
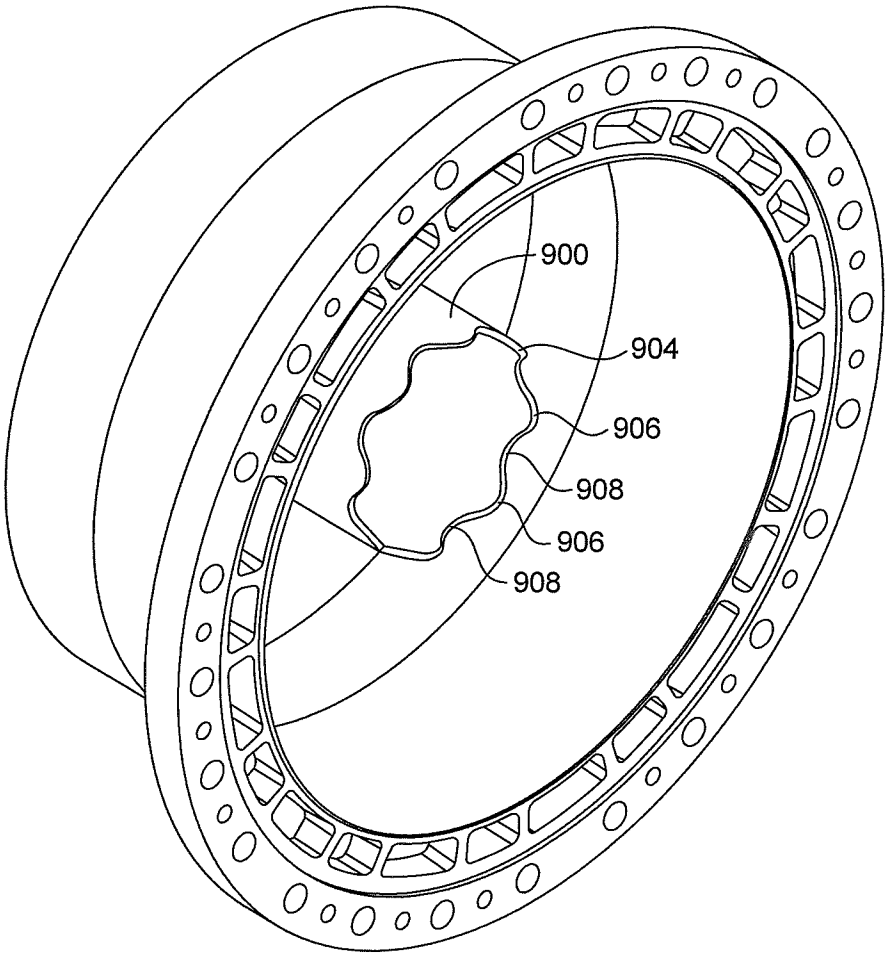
FIG. 9 is a perspective view of a portion of a gas turbine combustion system in accordance with an additional embodiment of the present invention.
Figure 10:
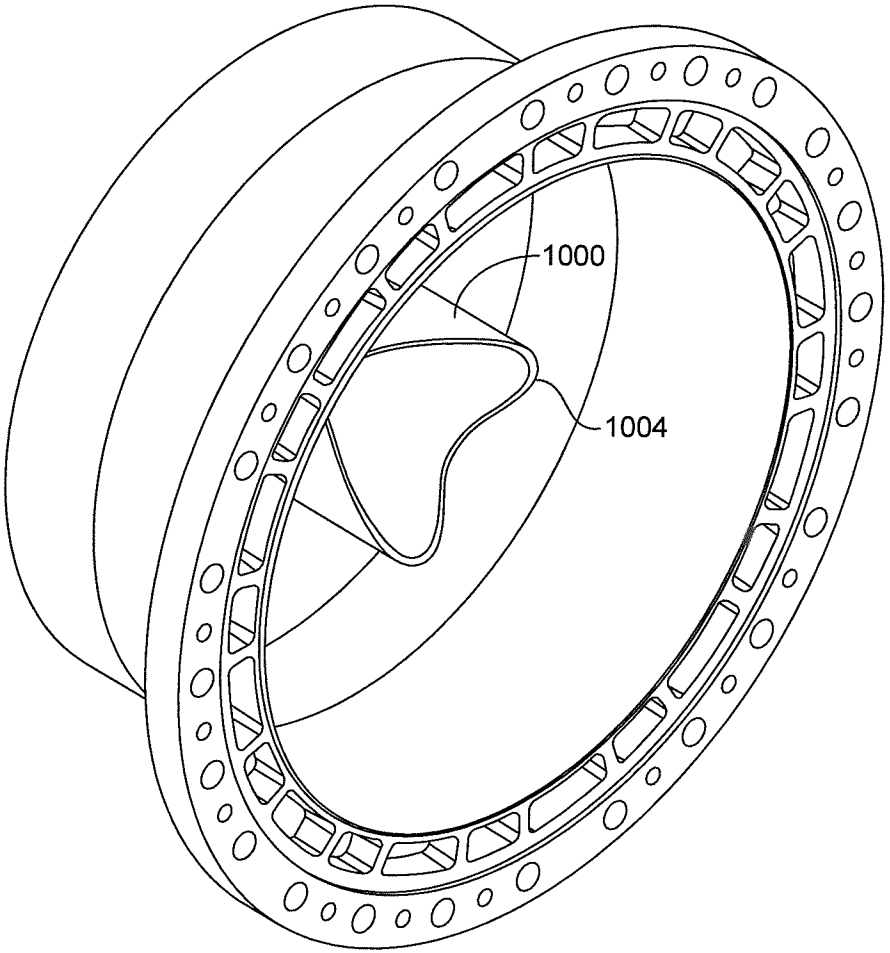
FIG. 10 is a perspective view of a portion of a gas turbine combustion system in accordance with yet another embodiment of the present invention.
Figure 11:
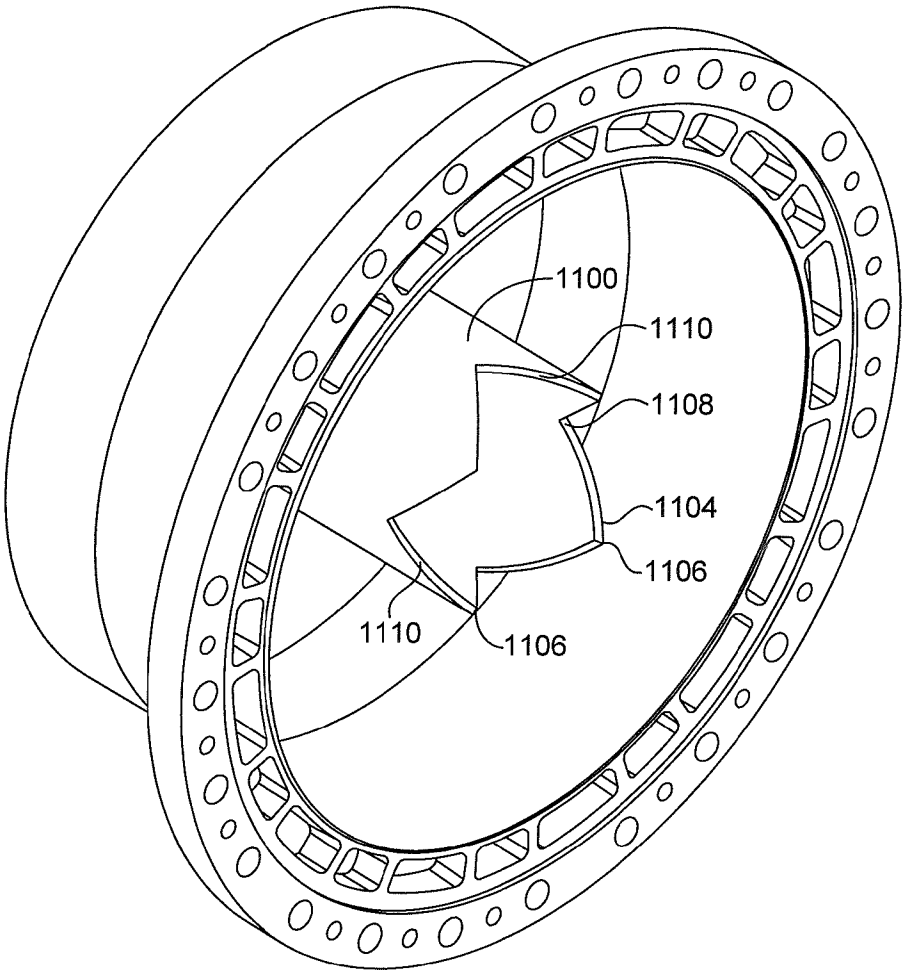
FIG. 11 is a perspective view of a portion of a gas turbine combustion system in accordance with a further embodiment of the present invention.

A series of alternate embodiments of the present invention are depicted in FIGS. 9-11, where the outlet end of the dome extension portion of the present invention can take on a variety of shapes in order to target certain frequencies of combustion acoustic pressure fluctuations. These alternative shapes to the outlet end may also aid in reducing thermal stresses in the dome extension. For example, the irregular profile of outlet end may consist of a variety of geometries, such as planar edges, continuous peaks and valleys or a combination of non-uniform exit plane geometries. The spacing of the features generating these profiles may be equal about the circumference of the outlet end or unequally spaced, depending on the frequency range of combustion acoustic pressure fluctuations being targeted.

Referring first to FIG. 9, this alternate embodiment discloses a generally cylindrical extension 900 having a different geometry than the embodiments discussed above. The generally cylindrical extension 900 has an inlet end 902 (not shown) that is coupled to the dome and functions similar to the prior configuration discussed above and pictured in FIGS. 2-8. The generally cylindrical extension 900 also has an opposing outlet end 904. In the configuration depicted in FIG. 9, it is possible to obtain the acoustic benefits driven primarily by the configuration of FIGS. 5 and 6, with the thermal stress reductions that can be obtained through the cutouts in the outlet end of the extension, as depicted in FIGS. 3-4B. That is, similar to the configuration discussed above with respect to FIGS. 7 and 8, the main difference with this alternate generally cylindrical extension 900 is with respect to the irregular shape of the outlet end 904. FIG. 9 depicts an outlet end 904 having a wave-like profile formed by a series of axial exit planes where the effective outlet end 904 varies axially along a length of the extension 900. These waves have a series of peaks 906 and troughs 908, which are essentially formed by connecting a series of axially-spaced planar cuts. The peaks 906 and troughs 908 can be uniformly spaced or non-uniformly spaced. As a result of this outlet end profile, fuel flow from the pilot nozzle mixes with the surrounding fuel-air mixture in a non-uniform and axially spaced fashion, thereby introducing asymmetries into the exit flow, which disrupts any coherent structures being formed that could otherwise amplify if injected in a symmetrical pattern.

FIG. 10 provides yet another alternative embodiment of an outlet end geometry for the extension. In this embodiment, a generally cylindrical extension 1000 has an inlet end 1002 (not shown) that is coupled to the dome and functions similar to the prior configuration discussed above and pictured in FIGS. 2-8. The generally cylindrical extension 1000 also has an opposing outlet end 1004. As discussed above, a profile of the outlet end 1004 can be non-uniform. This is shown in FIG. 10, which depicts a generally cylindrical extension 1000, where the outlet end 1004 exhibits a non-uniform profile along the axial distance forming the outlet end 1004 extends. As with the embodiment depicted in FIG. 9, fuel flow from the pilot nozzle, which extends along a center axis, can mix with the surrounding fuel-air mixture in a non-uniform and axially spaced fashion, thereby providing a way of targeting a reduction of certain frequencies of combustion acoustic pressure fluctuations.

Referring now to FIG. 11, a portion of the gas turbine combustion system is shown including a generally cylindrical extension 1100 having an inlet end (not shown) that is coupled to the dome and functions similar to the prior configurations discussed above and pictured in FIGS. 2-8. The generally cylindrical extension 1100 also has an opposing outlet end 1104. As discussed above, a profile of outlet end 1104 can be non-uniform. More specifically, the outlet end 1104 can have an outlet edge formed by multiple axially-spaced exit planes, as discussed above, but these multiple axially-spaced planes are taken at varying radii relative to the center axis of the combustor, thereby defining radial peaks 1106 and valleys 1108 in the generally cylindrical extension 1100. That is, the generally cylindrical extension 1100 can flare radially inward or outward relative to the center axis of the combustor, as represented by arc-shaped portion 1110 of generally cylindrical extension 1100.

Figure 12:
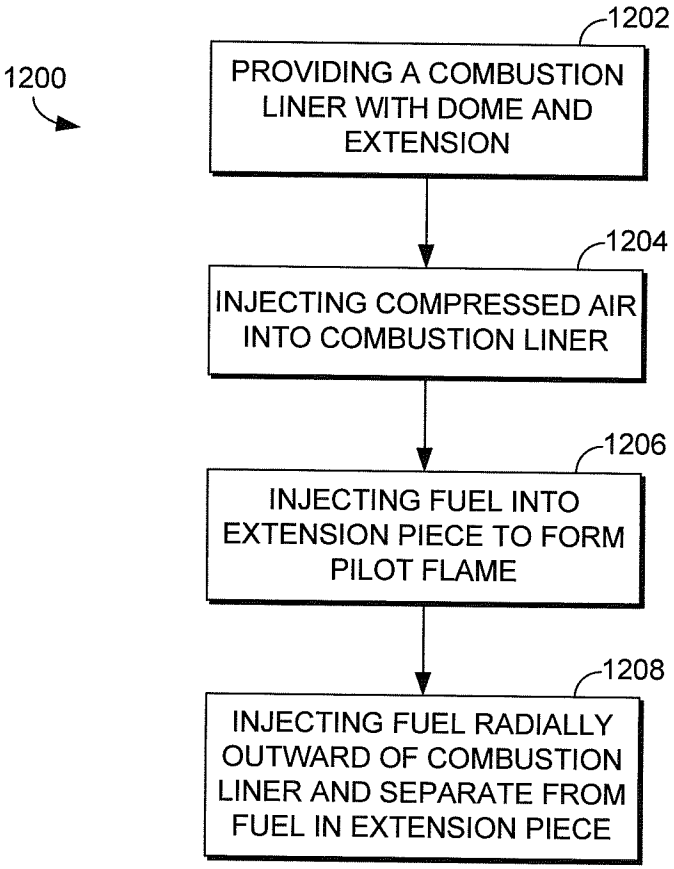
FIG. 12 depicts the process of isolating a main stage of fuel injectors from a pilot stage in accordance with an embodiment of the present invention.

The present invention also provides a way of isolating a main stage of fuel injectors from a pilot fuel nozzle such that acoustic dynamics in the combustion system are reduced. Referring now to FIG. 12, the process 1200 for isolating the main stage of fuel injectors is depicted. In a step 1202, a combustion liner is provided for a combustion system with the combustion liner having a hemispherical dome with an opening located therein and a generally cylindrical extension positioned at the opening and extending into the combustion liner. As discussed above, the generally cylindrical extension piece has an irregular profile or shape to the outlet end. Next, in a step 1204, a flow of compressed air is injected into the combustion liner and around the hemispherical dome. In a step 1206, a first stream of fuel is injected into the generally cylindrical extension piece in order to mix with a portion of the compressed air injected in step 1204 for providing a pilot flame. A second stream of fuel is injected in a step 1208 from a position radially outward of the combustion liner such that the second stream of fuel mixes with compressed air from step 1204 and the fuel-air mixture reverses flow direction upon contact with the hemispherical dome and enters the combustion liner to form a main injection flame. The extension piece serves to separate the stream of fuel for the pilot flame from the stream of fuel for the main injection flame. The irregular shape or profile of the extension piece creates asymmetries in the fuel injection location and thereby destroys any coherent structures between the pilot flame and main injection flame.

While the invention has been described in what is known as presently the preferred embodiment, it is to be understood that the invention is not to be limited to the disclosed embodiment but, on the contrary, is intended to cover various modifications and equivalent arrangements within the scope of the following claims. The present invention has been described in relation to particular embodiments, which are intended in all respects to be illustrative rather than restrictive. Alternative embodiments and required operations will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

The invention claimed is:

1. A gas turbine combustion system, the system comprising:

a cylindrical flow sleeve;

a cylindrical combustion liner located at least partially within the cylindrical flow sleeve;

a dome located forward of the cylindrical flow sleeve and encompassing at least a forward portion of the cylindrical combustion liner, the dome having a hemispherical head end and an opening located coaxial with a center axis of the cylindrical combustion liner; and a cylindrical extension projecting into the cylindrical combustion liner from the dome, the cylindrical extension having an inlet end, an outlet end, and an opening aligned with the opening in the dome, wherein the outlet end extends to a planar edge that includes a plurality of semi-circular cutouts around a circumference of the outlet end; wherein the planar edge of the outlet end is oriented at an angle relative to the center axis of the cylindrical combustion liner, wherein the angle is greater than zero and is non-orthogonal.

2. The system of claim 1, wherein the opening in the dome and the opening in the cylindrical extension are a same size.

3. The system of claim 1, wherein the cylindrical extension is secured to the dome.

4. The system of claim 1, wherein the plurality of semi-circular cutouts are equally spaced about the circumference of the outlet end.

5. The system of claim 1, wherein a depth of each of the plurality of semi-circular cutouts in a direction perpendicular to the planar edge is less than a width of portions of the outlet end that are between the plurality of semi-circular cutouts.

6. The system of claim 1, wherein each of the plurality of semi-circular cutouts is less than half an area of a circle of which it forms a portion.

7. The system of claim 1, further comprising a radial inflow mixer positioned adjacent to the opening in the dome.

8. The system of claim 1, further comprising a pilot nozzle positioned along the center axis of the cylindrical combustion liner and extending into the cylindrical extension.

9. An extension for a dome of a gas turbine combustor, the extension comprising:

a cylindrical member extending along a center axis of the gas turbine combustor and having an inlet end with an inlet diameter and an outlet end with an outlet diameter, wherein the outlet end extends to a planar edge that includes a plurality of semi-circular cutouts around a circumference of the outlet end, wherein the planar edge of the outlet end is oriented at an angle relative to the center axis of the gas turbine combustor, and wherein the planar edge is non-orthogonal and non-parallel with the center axis of the gas turbine combustor.

10. The extension of claim 9, wherein the angle is between 1 and 89 degrees relative to the center axis.

11. The extension of claim 9, wherein the angle is between 91 and 179 degrees relative to the center axis.

12. The extension of claim 9, wherein the plurality of semi-circular cutouts are spaced equally around the outlet end of the cylindrical member.

13. The extension of claim 9, wherein a depth of the plurality of cutouts in a direction perpendicular to the planar edge is less than a width of portions of the outlet end that are between the plurality of semi-circular cutouts.

14. The extension of claim 9, further comprising an opening in the dome through which a pilot fuel nozzle is located, the pilot fuel nozzle terminating at a position within the extension.

15. The extension of claim 9, wherein the dome tapers in diameter from the inlet diameter to the outlet diameter.

16. A method of isolating a main stage of fuel injectors from a pilot fuel nozzle of a gas turbine combustor in order to improve turndown and avoid quenching of a hot stage of the gas turbine combustor, the method comprising:

providing a combustion liner having a hemispherical dome encompassing an inlet to the combustion liner, the hemispherical dome having an opening and a cylindrical extension piece extending from the opening of the hemispherical dome and into the combustion liner, the cylindrical extension piece having an outlet end that extends to a planar edge that includes a plurality of semi-circular cutouts around a circumference of the outlet end, wherein the planar edge is non-orthogonal and non-parallel relative to a center axis of the combustion liner;

injecting a flow of compressed air into the combustion liner and around the hemispherical dome;

injecting a first stream of fuel into the cylindrical extension piece to mix with a portion of the compressed air for providing a pilot flame;

injecting a second stream of fuel from a position radially outward of the combustion liner such that the second stream of fuel mixes with a portion of the compressed air and reverses direction upon contact with the hemispherical dome for providing a main injection flame in the combustion liner;

wherein the cylindrical extension piece separates the first stream of fuel from the second stream of fuel, and wherein the plurality of semi-circular cutouts create asymmetries in fuel injection location and respective flame structures, thereby destroying any coherent structures between the pilot flame and the main injection flame proximate the cylindrical extension piece.

17. The method of claim 16, wherein the outlet end has a different diameter than that of an inlet to the cylindrical extension piece.

18. The method of claim 16, wherein the plurality of semi-circular cutouts are equally spaced around the outlet end.

19. The method of claim 16, wherein a depth of the plurality of semi-circular cutouts in a direction perpendicular to the planar edge is less than a width of portions of the outlet end that are between the plurality of semi-circular cutouts.

20. The method of claim 16, wherein the first stream of fuel and the second stream of fuel are each a gaseous fuel.

* * * * *